US005566562A

United States Patent [19]

Fujii

[11] Patent Number: 5,566,562

[45] Date of Patent: Oct. 22, 1996

[54] LOCKING SYSTEM FOR VEHICLE DOORS

[75] Inventor: Hiroshi Fujii, Heelands, United Kingdom

[73] Assignee: Nissan Motor Co., Ltd., Yokohama, Japan

[21] Appl. No.: 274,261

[22] Filed: Jul. 13, 1994

[30] Foreign Application Priority Data

Jul. 14, 1993 [JP] Japan ..... 5-173486

[51] Int. Cl.[6] ..... E05B 47/00

[52] U.S. Cl. ..... 70/277; 70/262; 70/276; 70/379 R

[58] Field of Search ..... 70/276, 278, 277, 70/280, 379 R, 379 A, 380, 262, 263, 264; 292/336.3

[56] References Cited

U.S. PATENT DOCUMENTS

| | | | |
|---|---|---|---|
| 2,339,170 | 1/1944 | Jacobs | 70/263 |
| 4,364,249 | 12/1982 | Kleefeldt | 70/264 |
| 4,563,885 | 1/1986 | Madden | 70/380 |
| 4,787,223 | 11/1988 | Gotanda | 70/264 |
| 4,910,980 | 3/1990 | Katoh | 70/278 |
| 5,428,978 | 7/1995 | Tsukano | 70/276 |

FOREIGN PATENT DOCUMENTS

| | | | |
|---|---|---|---|
| 0478013 | 4/1992 | European Pat. Off. | 70/277 |
| 2034802 | 6/1980 | United Kingdom | 70/263 |
| 2262769 | 6/1993 | United Kingdom | 70/262 |

*Primary Examiner*—Darnell M. Boucher
*Attorney, Agent, or Firm*—Foley & Lardner

[57] ABSTRACT

In a door locking system of the type having a security mechanism for locking a locking button when a lock cylinder is locked, a switch lever is installed on a lock cylinder main body for rotation therewith, and an operating force transmitting lever is rotatably installed on the lock cylinder main body and operatively connected to the locking button. The switch lever and the operating force transmitting lever are connected in such a manner as to allow, when the lock cylinder main body is rotated from a locking position to a security mechanism unlocking position, the switch lever to rotate relative to the operating force transmitting lever. When the switch lever is rotated into the security mechanism unlocking position, the security mechanism is electrically or electromagnetically actuated to unlock the locking button.

9 Claims, 4 Drawing Sheets

LOCKING SYSTEM FOR VEHICLE DOORS

BACKGROUND OF THE INVENTION

1. Field of the Invention

The present invention relates in general to a locking system for vehicle doors and particularly to an automotive door locking system of the type having an antitheft deadlock or security mechanism.

2. Description of the Prior Art

A known door locking system is provided with an antitheft deadlock or security mechanism adapted to hold a locking lever, which is movable between a locking position and an unlocking position for locking and unlocking a locking mechanism, in the locking position and prevent movement of the locking lever out of the locking position when the locking mechanism has been locked by a lock cylinder which is operated from the outside of the doer with a key. Insofar as the security mechanism holds the locking lever in the locking position, the locking mechanism cannot be unlocked by a locking button which is operated from the inside of the door. By this, it is intended to attain an improved antitheft effect since the locking mechanism cannot be unlocked even when an access to the locking button is attained by a breaking of a door glass. A door locking system having such a locking lever is disclosed in GB 2,034,802.

When the locking mechanism is to be unlocked, an unlocking switch is operated to make the security mechanism unlock the locking lever, prior to an operation of the lock cylinder for unlocking the locking mechanism.

A problem of the prior art door locking system of the above described kind is that unlocking of the locking mechanism requires a troublesome operation since an addition operation of an unlocking switch for unlocking the security mechanism is necessary prior to an unlocking operation of the lock cylinder.

SUMMARY OF THE INVENTION

In accordance with the present invention, there is provided a novel and improved locking system for a door. The locking system comprises a locking mechanism capable of being locked and unlocked for locking and unlocking the door, respectively, a lock cylinder connected via a first rod to the locking mechanism and operated from the outside of the door, the lock cylinder having a lock cylinder main body rotatable between a locking position and an unlocking position for causing the locking mechanism to be locked and unlocked, respectively, a locking button connected via a second rod to the locking mechanism and operated from the inside of the door, the locking button being movable between a locking position and an unlocking position for causing the locking mechanism to be locked and unlocked, respectively, a security mechanism electrically or electromagnetically actuated to lock the locking button in the locking position thereof or unlock the locking button, control circuit means for controlling electric or electromagnetic actuation of the security mechanism, locking switch means for supplying, when closed in response to rotation of the lock cylinder main body into the locking position thereof, to the control circuit means a signal for causing the security mechanism to lock the locking button in the locking position thereof, unlocking switch means for supplying, when closed in response to rotation of the lock cylinder main body into the security mechanism unlocking position, to the control circuit means a signal for causing the security mechanism to unlock the locking button, and a lever unit installed on an end portion of the lock cylinder main body for transmitting an operation force applied to the lock cylinder to the first rod whilst converting rotary motion of the lock cylinder main body to reciprocating motion of the first rod.

The lock cylinder main body is further rotatable into a security mechanism unlocking position located between the locking position and the unlocking position.

The lever unit has a switch lever installed on said end portion of the lock cylinder main body for rotation therewith for causing the locking switch means to be closed when the lock cylinder main body is rotated into the locking position thereof and for causing the unlocking switch means to be closed when the lock cylinder main body is rotated into the security mechanism unlocking position, an operation force transmitting lever rotatably installed on the end portion of the lock cylinder main body and connected to the first pull rod, spring means interposed between the switching lever and the operating force transmitting lever for urging the operating force transmitting lever toward the unlocking position thereof, and engagement means having an arcuated slit and a guide projection movable in the arcuated slit for engaging the switch lever and the operating force transmitting lever in such a manner as to allow, when the lock cylinder main body is rotated from the locking position to the security mechanism unlocking position, the switch lever to rotate relative to the operating force transmitting lever.

The above structure is effective for solving the above noted problem inherent in the prior art device.

It is accordingly an object of the present invention to provide a novel and improved door locking system of the type having a securing mechanism which can be operated with ease though reliable in operation.

It is a further object of the present invention to provide a novel and improved door locking mechanism of the above described character which does not require a particular operation for unlocking the security mechanism in addition to an operation of a lock cylinder in case of unlocking a locking mechanism.

It is a further object of the present invention to provide a novel and improved door locking system of the above described character which makes it possible to unlock the security mechanism automatically during an operation of the lock cylinder toward an unlocking position for unlocking the locking mechanism.

DETAILED DESCRIPTION OF THE PREFERRED EMBODIMENT

Figure 1:
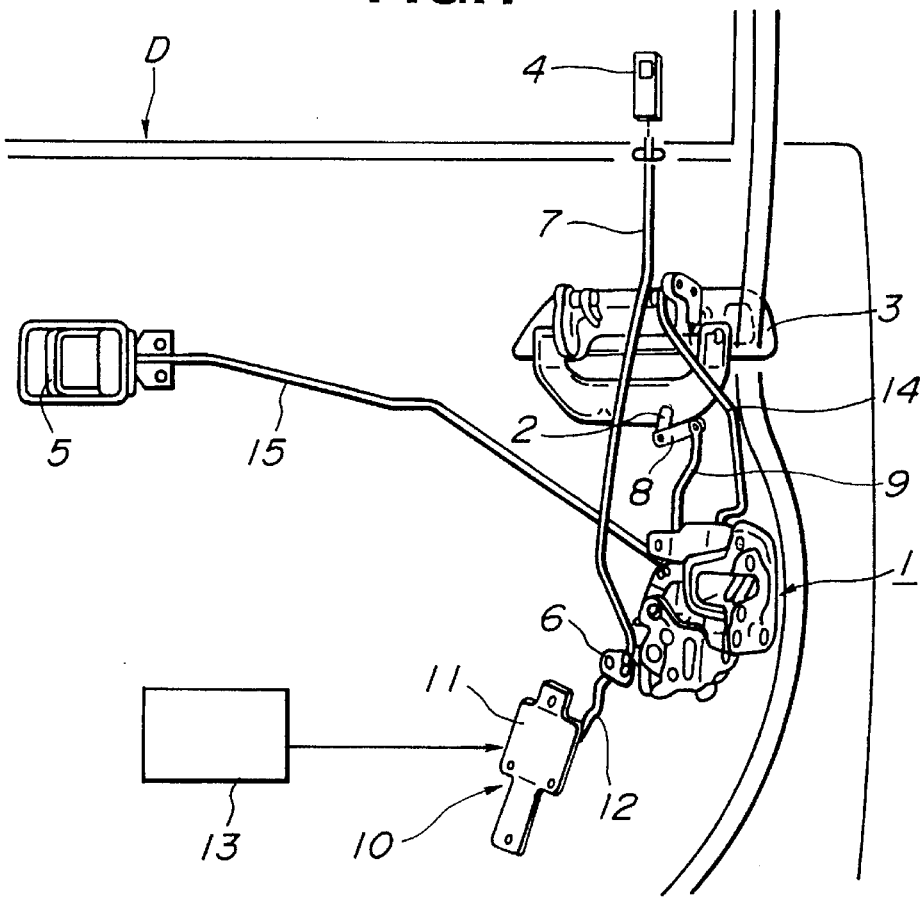
FIG. 1 is a perspective view of a door locking system of the type having a security mechanism, to which the present invention is applicable.

Referring first to FIG. 1, a general structure of a door locking system equipped with a deadlock or security mechanism will be described briefly. The door locking system includes a locking mechanism 1 installed on a door "D" and capable of being locked and unlocked to lock and unlock the door "D", a lock cylinder 2 disposed adjacent an outside door handle 3 and adapted to be operated from the outside of the door "D" with a key, a locking knob or button 4 installed on a waist portion of the door "D" in such a way as to project upward therefrom and adapted to be manually operated from the inside of the door "D", and an inside door handle 5. The locking mechanism 1 has a locking lever 6 movable between a locking position and an unlocking position for locking and unlocking the locking mechanism 1. The locking lever 6 is connected via a pull rod 7 to the locking button 4 so that the locking mechanism 1 can be locked or unlocked by the operation of the locking button 4. When the lock cylinder 2 is operated to lock or unlock the locking mechanism via a lock cylinder lever 8 and a pull rod 9, the locking lever 6 is operated toward a locking position or an unlocking position together with other locking levers (not shown) for all of other doors by means of electromagnetic actuators (not shown).

The door locking system further includes an antitheft deadlock or security mechanism 10 which is provided to the locking mechanism 1 and includes a motor-driven actuator 11 and a rod 12 connected to the locking lever 6. By the rod 12, the docking lever 6 is locked and unlocked. The security mechanism 10 is adapted to be controlled by a control circuit 13 in response to a signal from a switching device which will be described in detail hereinafter. When the lock cylinder 2 is operated toward a locking position with a key, the security mechanism 10 locks the locking lever 6 in the locking position after the locking mechanism 1 has been locked. When the lock cylinder 2 is operated toward an unlocking position with a key, the security mechanism 10 can be operated to unlock the locking lever 6 without requiring such a troublesome operation of an unlocking switch as in a prior art system, which will be explained hereinafter in detail.

In the meantime, 14 is a pull rod connecting between the outside handle 3 and the locking mechanism 1, and 15 is a pull rod connecting between the inside handle 5 and the locking mechanism 1.

Figure 3:
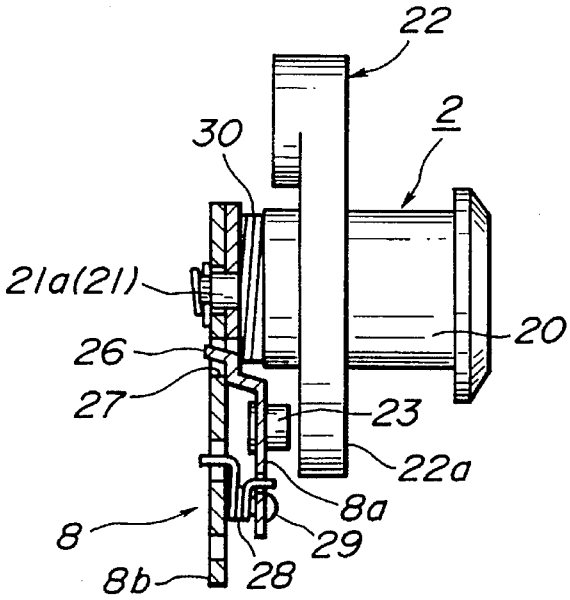
FIG. 3 is a side elevational view of the lock cylinder and the lever unit in an assembled condition.
Figure 2:
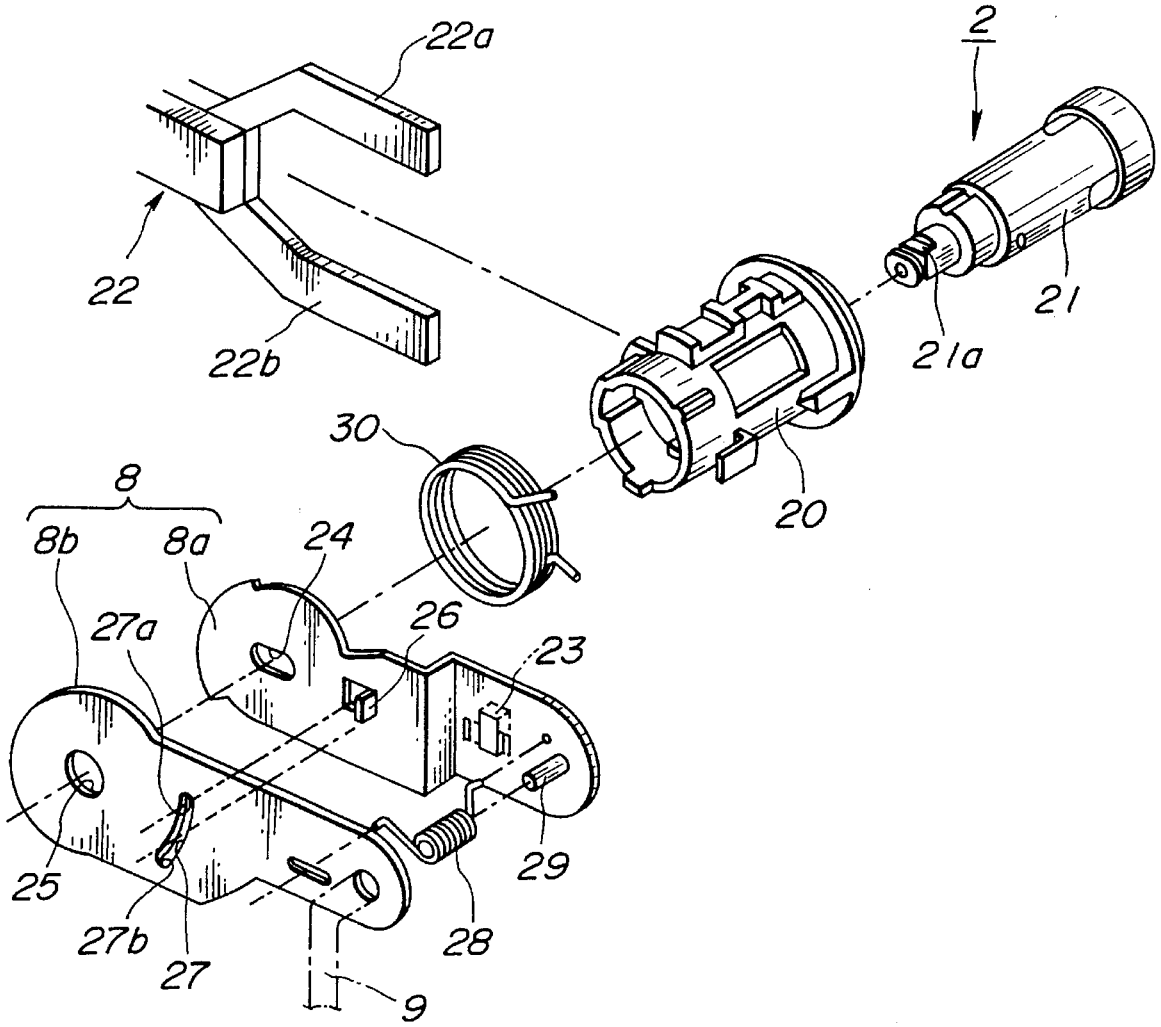
FIG. 2 is an exploded view of a lock cylinder and a lever unit of a door locking system according to an embodiment of the present invention.

Referring now to FIGS. 2 to 3, the lock cylinder 2 includes a cylinder casing 20 fixedly attached to the door "D", and a lock cylinder proper or main body 21 rotatably encased in the cylinder casing 20. A switching device 22 is disposed around or adjacent the periphery of the cylinder casing 20 for detecting a locking or unlocking operation of the lock cylinder 2.

The switching device 22 has a forked or bifurcated shape so as to straddle the cylinder casing 20 and includes an upper locking switch **22*a* for supplying to the control circuit 13 a locking command signal for causing the security mechanism 10 to be locked, and a lower unlocking switch 22*b* for supplying to the control circuit 13 an unlocking command signal for causing the security mechanism 10** to be unlocked.

In this embodiment, both of the locking switch **22*a* and the unlocking switch 22*b* are lead switches which are switched on or closed when coming close to and to face a magnet 23 which will be described hereinlater. Specifically, the locking switch 22*a* is arranged so as to come close to and to face the magnet 23 and be closed when a switch lever 8*a* is rotated into a locking position "A" in FIG. 4. The unlocking switch 22*b* is arranged so as to come close to and to face the magnet 23 and be closed when the switch lever 8*a* is rotated into an unlocking position "B" in FIG. 4**.

A lock cylinder lever unit 8 is installed on an end portion of the lock cylinder main body 21 so as to transmit an operating force applied to the lock cylinder main body 21 to the rod 9 whilst converting rotational motion of the lock cylinder main body 21 to vertical reciprocating motion of the rod 9. The lock cylinder lever unit 8 consists of the above mentioned switch lever **8*a* having at an end the magnet 23 for controlling closing and opening of the locking switch 22*a* and the unlocking switch 22*b*, and an operating force transmitting lever 8*b* connected at an end to the rod 9**.

The switch lever **8*a* has a noncircular opening 24 at an end portion. The lock cylinder main body 21 has a noncircular end portion 21*a*. The switch lever 8*a* is fitted and engaged at the noncircular opening 24 on and with the noncircular end portion 21*a* of the lock cylinder main body 21. By this, the switch lever 8*a* is assembled with the lock cylinder main body 21 in such a manner as to be rotatable with the lock cylinder main body 21 toward a locking position and an unlocking position thereof. The operation force transmitting lever 8*b* has at an end thereof a circular opening 25 and is rotatably installed on the noncircular portion 21*a* of the lock cylinder proper 21 by inserting the noncircular end portion 21*a* of the lock cylinder main body 21 into the circular opening 25**.

Figure 4:
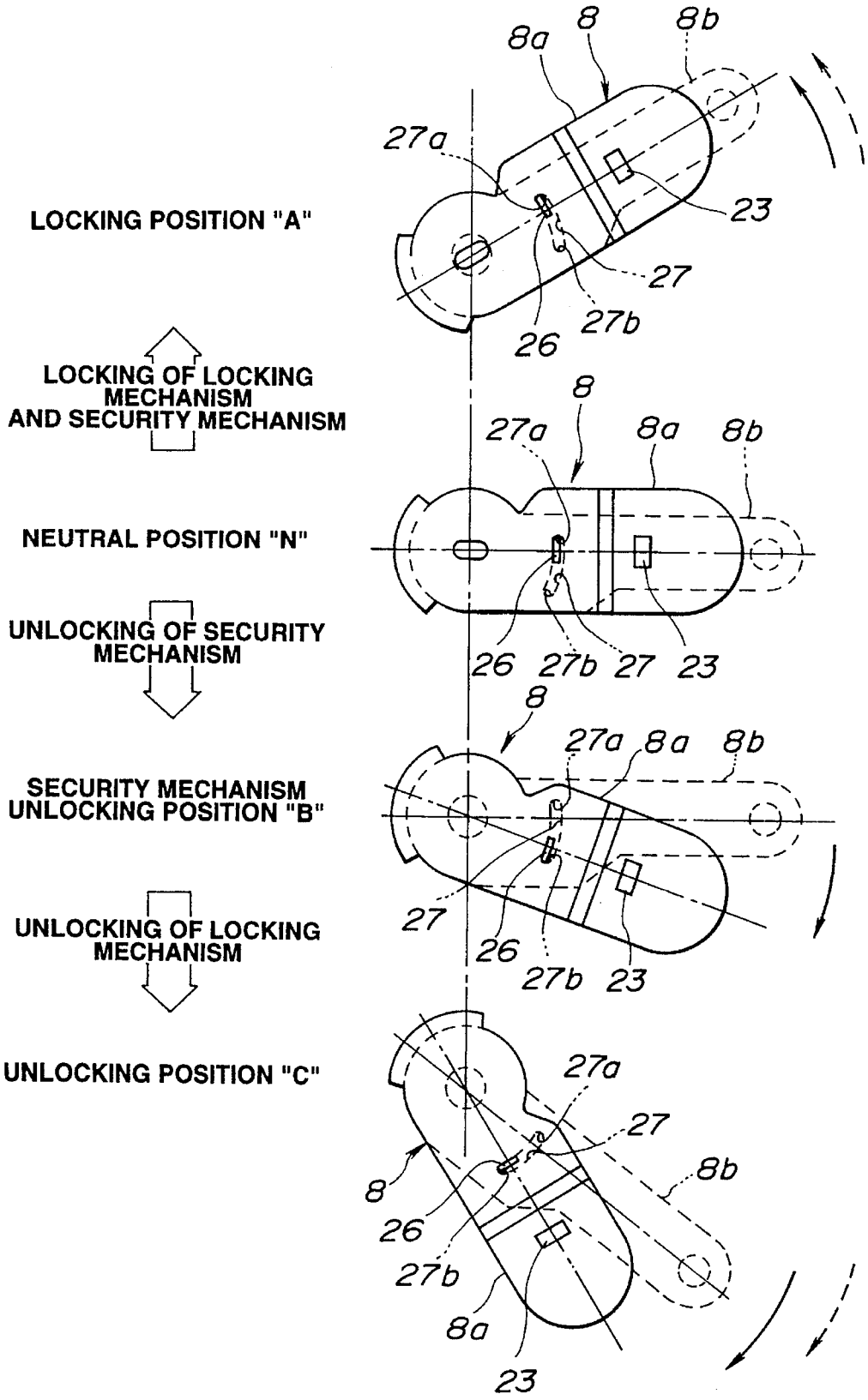
FIG. 4 is an illustration of various operating positions of levers constituting part of the lever unit of FIG. 2.

The switch lever **8*a* and the operating force transmitting lever 8*b* are coupled with each other by inserting a guide projection 26 of the switch lever 8*a* into an arcuated slit 27 constituting part of a circular slit formed round the center of the opening 25, whilst a torsional spring 28 in a loaded state is interposed between the switch lever 8*a* and the operating force transmitting lever 8*b* in such a manner that the operating force transmitting lever 8*b* is urged toward an unlocking position "C" in FIG. 4 and that a locking side stopper end 27*a* of the arcuated slit 27 is usually held engaged with the guide projection 26 as seen from portions of FIG. 4 for illustrating the locking position "A" and a neutral position "N". As seen from FIG. 4, the lock cylinder main body 21** is rotatable between a locking position "A" and an unlocking position "C" and further rotatable into a security mechanism unlocking position "B" between the locking position "A" and the unlocking position "C" and into a neutral position "N" between the locking position "A" and the securing mechanism unlocking position "B".

The length of the arcuated slit 27 is determined so that when the switch lever **8*a* is rotated relative to the operating force transmitting lever 8*b* into a security mechanism unlocking position "B" and allows the magnet 23 to come close to and to face the unlocking switch 22*b*, the guide projection 26 is just engaged with an unlocking side stopper end 27*b* of the arcuated slit 27 as seen from a portion of FIG. 4** for illustrating the security mechanism unlocking position "B".

The switch lever **8*a* has a pin 29 for retaining or supporting the spring 28, i.e., the spring 28 is placed around the pin 29. A torsional return spring 30 is disposed between the cylinder casing 20 and the switch lever 8*a* to return the switch lever 8*a*** to the neutral position "N".

Figure 5:
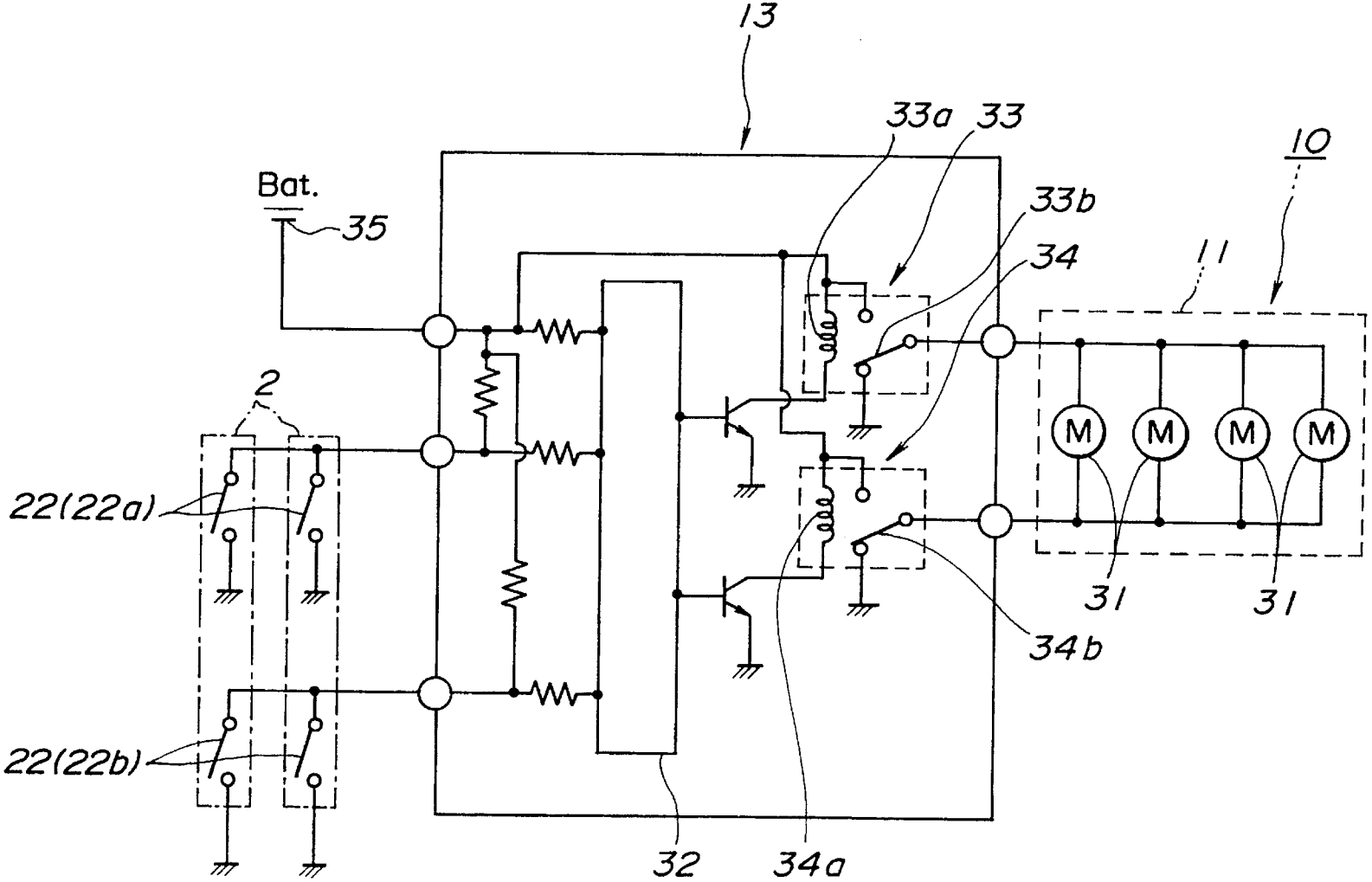
FIG. 5 is a diagram of a control circuit for a security mechanism for use in the locking system of the present invention.

FIG. 5 shows the control circuit 13 for the security mechanism 10. In this embodiment, the control circuit 13 is adapted to control motors 31 of actuators 11 for each security mechanisms 10 provided to each doors of a 4-door vehicle.

A signal indicative of closure of the locking switch **22*a* or the unlocking switch 22*b* of the switching device 22 is supplied therefrom to a CPU (central processing unit) 32**.

The CPU 32 is adapted to supply to the security mechanism 10 a signal for causing the security mechanism 10 to be locked when supplied with the signal indicative of closure of the locking switch 22*a*, and supply to the security mechanism 10 a signal for causing the security mechanism to be unlocked when supplied with the signal indicative of closure of the unlocking switch 22*b*.

Each motor 31 is built in the actuator 11 of each securing mechanism 10 and causes, when for example rotated in the normal direction, the rod 12 of the actuator 11 to move forward to lock the locking lever 6 of the locking mechanism 1 in the locking position and, when rotated in the reverse direction, causes the rod 12 to move backward to unlock the locking lever 6.

Each motor 31 is driven in the normal direction when the voltage of a battery 35 is applied via the CPU 32 to a coil 33*a* of a relay 33 for locking drive in response to a signal indicative of closure of the locking switch 22*a* and a contact 33*b* is thrown into a closed position to form a closed loop. On the other hand, each motor 31 is driven in the reverse direction when the voltage of the battery 35 is applied via the CPU 32 to a coil 34*a* of a relay 34 for unlocking drive in response to a signal indicative of closure of the unlocking switch 22*b* and a contact 34*b* is thrown into a closed position to form a closed loop.

With the above structure, an operation of the lock cylinder 2 in the direction to lock the locking mechanism 1 causes the switch lever 8*a* and the operating force transmitting lever 8*b* to rotate as one body due to engagement of the guide projection 26 and the locking side stopper end 27*a* of the arcuated slit 27. When the operating force transmitting lever 8*b* is rotated into the locking position "A" together with the switch lever 8*a*, it operates the locking mechanism by way of the pull rod 9 and causes the same to be locked.

In case the lock cylinder main body 21 is returned to the neutral position "N" and thereafter operated once again toward the locking position "A", it can be operated with a small operating force since the locking mechanism 1 has been locked and does not require any operation force therefor. When the lock cylinder main body 21 is rotated into the locking position "A", the magnet 23 of the switch lever 8*a* comes close to and to face the locking switch 22*a* to cause the locking switch 22*a* to be closed. In response to this, as mentioned before, the control circuit 13 supplied to the security mechanism 10 a signal for causing the security mechanism 10 to be locked. The actuator motor 11 is thus actuated to drive the rod 12, so that the rod 12 locks the locking button 6 in the locking position thereof for thereby attaining a so-called deadlock condition of the locking mechanism 1.

In case of unlocking the locking mechanism 1, the lock cylinder main body 21 is operated toward the unlocking position "C". The operating force transmitting lever 8*b* however keeps standstill or is held stationary since it is locked via the rod 9 by means of the security mechanism 10. So, only the switch lever 8*a* is rotated toward the unlocking position "C" due to relatively movable engagement of the guide projection 26 and the arcuated slit 27.

In this instance, the switch lever 8*a* can be rotated with a small operating force since no operation force for operating the locking mechanism 1 is needed.

When the switch lever 8*a* is rotated relative to the operating force transmitting lever 8*b* into a security mechanism unlocking position "B" where the guide projection 26 is abuttingly engaged with the unlocking side stopper end 27*b* of the arcuated slit 27, the magnet 23 comes close to and to face the unlocking switch 22*b* to cause the unlocking switch 22*b* to be closed.

In response to this, the control circuit 13 supplies to the securing mechanism 10 a signal for causing the security mechanism 10 to be unlocked. The actuator 11 is thus actuated to drive the rod 12 in such a manner that the rod 12 unlocks the locking button 6 for thereby unlocking the security mechanism 10, i.e., releasing the locking mechanism 1 from the deadlock condition prior to unlocking of the locking mechanism 1.

When the lock cylinder main body 21 is then operated toward the unlocking position "C", the switch lever 8*a* and the operating force transmitting lever 8*b* are rotated as one body due to engagement of the guide projection 26 and the unlocking side stopper end 26 of the arcuated slit 27 to unlock the locking mechanism 1 by way of the rod 9.

While the actuator of the security mechanism has been described as being of a motor-driven type, i.e., an electrically operated type, it can otherwise be of an electromagnetically operated type.

From the foregoing, it will be understood that according to the present invention it becomes possible, when it is desired to lock the locking mechanism, to rotate the switch lever and the transfer lever as one body for thereby locking the locking mechanism whilst operating the locking switch of the switching device by means of the switch lever for thereby locking the security mechanism.

It will be further understood that according to the present invention it becomes possible, when it is desired to unlock the locking mechanism, to rotate only the switch lever into the security mechanism unlocking position without requiring any operating force for operating the locking mechanism and therefore with a small operating force, for operating the unlocking switch by means of the switch lever for thereby unlocking the securing mechanism prior to unlocking of the locking mechanism, so that after that the switch lever and the operating force transmitting lever are rotatable as one body to unlock the locking mechanism.

Accordingly, in case of unlocking the locking mechanism, it becomes possible to unlock the securing mechanism and then the locking mechanism by an operation of the lock cylinder main body in one direction, i.e., toward an unlocking position thereof, thus making it possible to improve the operational ability of the locking system considerably and therefore making it possible to provide a locking system which is practically useful so much.

What is claimed is:

1. A locking system for a door, comprising:

a locking mechanism capable of being locked and unlocked for locking and unlocking the door, respectively;

a lock cylinder connected via a first rod to said locking mechanism and operated from the outside of the door, said lock cylinder having a lock cylinder main body rotatable between a locking position and an unlocking position for causing said locking mechanism to be locked and unlocked, respectively;

a locking button connected via a second rod to said locking mechanism and operated from the inside of the door, said locking button being movable between a locking position and an unlocking position for causing said locking mechanism to be locked and unlocked, respectively;

a security mechanism operable for at least one of electric or electromagnetic actuation to lock said locking button in said locking position thereof and to unlock said locking button;

control circuit means for controlling said at least one of electric or electromagnetic actuation of said security mechanism;

locking switch means for supplying, when closed in response to rotation of said lock cylinder main body into said locking position thereof, to said control circuit means a signal for causing said security mechanism to lock said locking button in said locking position thereof;

unlocking switch means for supplying, when closed in response to rotation of said lock cylinder main body into said security mechanism unlocking position, to said control circuit means a signal for causing said security mechanism to unlock said locking button; and a lever unit installed on an end portion of said lock cylinder main body for transmitting an operation force applied to said lock cylinder to said first rod whilst converting rotary motion of said lock cylinder main body to reciprocating motion of said first rod;

said lock cylinder main body being further rotatable into a security mechanism unlocking position located between said locking position and said unlocking position;

said lever unit having a switch lever installed on said end portion of said lock cylinder main body for rotation therewith for causing said locking switch means to be closed when said lock cylinder main body is rotated into said locking position thereof and for causing said unlocking switch means to be closed when said lock cylinder main body is rotated into said security mechanism unlocking position, an operating force transmitting lever rotatably installed on said end portion of said lock cylinder main body and connected to said first rod, spring means interposed between said switch lever and said operating force transmitting lever for urging said operating force transmitting lever toward said unlocking position thereof, and engagement means having an arcuated slit and a guide projection movable in said arcuated slit for engaging said switch lever and said operating force transmitting lever in such a manner as to allow, when said lock cylinder main body is rotated from said locking position to said security mechanism unlocking position, said switch lever to rotate relative to said operating force transmitting lever.

2. A locking system according to claim 1, wherein said locking switch means and said unlocking switch means comprise a locking switch and an unlocking switch which are disposed on opposite sides of said lock cylinder, respectively, and a magnet installed on said switch lever so as to come close to and to face said locking switch when said switch lever is rotated into said locking position thereof and so as to come close to and to face said unlocking position when said switch lever is rotated into said security mechanism unlocking position.

3. A locking system according to claim 2, wherein said locking switch means and said unlocking switch means further comprises a stationary bifurcated member straddling said lock cylinder, said locking switch and said unlocking switch being installed on said bifurcated member.

4. A locking system according to claim 1, wherein said switch lever is formed with said guide projection, and said operating force transmitting lever is formed with said arcuated slit.

5. A locking system according to claim 4, wherein said operating force transmitting lever has a pivot opening for installation thereat on said lock cylinder main body, said arcuated slit being in the form of part of a circular slit formed round a center of said pivot opening.

6. A locking system-according to claim 5, wherein said lock cylinder main body is further rotatable into a neutral position between said locking position and said security mechanism unlocking position, and said arcuated slit has a locking side stopper end and an unlocking side stopper end, said arcuated slit and said guide projection being constructed and arranged such that said guide projection is held engaged with said locking side stopper end of said arcuated slit under the bias of said spring means when said lock cylinder main body is in said neutral position, so that said switch lever and said operating force transmitting lever are rotatable as one body when said lock cylinder main body is operated toward said locking position thereof.

7. A locking system according to claim 6, wherein said arcuated slit and said guide projection are constructed and arranged such that said guide projection is just engaged with said unlocking side stopper end of said arcuated slit when said lock cylinder main body is rotated into said security mechanism unlocking position, so that said switch lever and said operating force transmitting lever are rotatable as one body when said lock cylinder main body is operated toward said unlocking position for unlocking said locking mechanism.

8. A locking system according to claim 1, wherein said lock cylinder main body is further rotatable into a neutral position between said locking position and said security mechanism unlocking position, said lock cylinder further comprising a lock cylinder casing in which said lock cylinder main body is rotatably encased, said lever unit further comprising spring means interposed between said lock cylinder casing and said switch lever for urging said switch lever into said neutral position.

9. A locking system for a door, comprising:

a locking mechanism capable of being locked and unlocked for locking and unlocking the door, respectively;

a lock cylinder connected via a first rod to said locking mechanism and operated from the outside of the door, said lock cylinder having a lock cylinder main body rotatable between a locking position and an unlocking position for causing said locking mechanism to be locked and unlocked, respectively;

a locking button connected via a second rod to said locking mechanism and operated from the inside of the door, said locking button being movable between a locking position and an unlocking position for causing said locking mechanism to be locked and unlocked, respectively;

a security mechanism operable for at least one of electric or electromagnetic actuation to lock said locking button in said locking position thereof and to unlock said locking button;

control circuit means for controlling said at least one of electric or electromagnetic actuation of said security mechanism;

locking switch means for supplying, when closed in response to rotation of said lock cylinder main body into said locking position thereof, to said control circuit means a signal for causing said security mechanism to lock said locking button in said locking position thereof;

unlocking switch means for supplying, when closed in response to rotation of said lock cylinder main body into said security mechanism unlocking position, to said control circuit means a signal for causing said security mechanism to unlock said locking button; and a lever unit installed on an end portion of said lock cylinder main body for transmitting an operation force applied to said lock cylinder to said first rod whilst converting rotary motion of said lock cylinder main body to reciprocating motion of said first rod;

said lock cylinder main body being further rotatable into a security mechanism unlocking position located between said locking position and said unlocking position;

said lever unit having a switch lever installed on said end portion of said lock cylinder main body for rotation therewith for causing said locking switch means to be closed when said lock cylinder main body is rotated into said locking position thereof and for causing said unlocking switch means to be closed when said lock cylinder main body is rotated into said security mechanism unlocking position, an operating force transmitting lever rotatably installed on said end portion of said lock cylinder main body and connected to said first rod, spring means interposed between said switch lever and said operating force transmitting lever for urging said operating force transmitting lever toward said unlocking position thereof, and engagement means having an arcuated slit and a guide projection movable in said arcuated slit for engaging said switch lever and said operating force transmitting lever in such a manner as to allow, when said lock cylinder main body is rotated from said locking position to said security mechanism unlocking position, said switch lever to rotate relative to said operating force transmitting lever;

wherein said lock cylinder main body is further rotatable into a neutral position between said locking position and said security mechanism unlocking position, said lock cylinder further including a stationary lock cylinder casing in which said lock cylinder main body is rotatably encased, said lever unit further comprising spring means, interposed between said stationary lock cylinder casing and said switch lever, for urging said switch lever into said neutral position such that said lock cylinder main body is held in said neutral position absent a driving force for driving said lock cylinder main body into one of said locking position, said security mechanism unlocking position, and said unlocking position.

* * * * *